US008769752B2

(12) United States Patent
Ade et al.

(10) Patent No.: US 8,769,752 B2
(45) Date of Patent: Jul. 8, 2014

(54) PRE-ASSEMBLED COLLAPSIBLE WALKWAY

(76) Inventors: Frederick Anton Ade, Wichita, KS (US); Matthew Robert Bemiss Garcia, Hutchinson, KS (US)

( * ) Notice: Subject to any disclaimer, the term of this patent is extended or adjusted under 35 U.S.C. 154(b) by 0 days.

(21) Appl. No.: 13/591,625

(22) Filed: Aug. 22, 2012

(65) Prior Publication Data

US 2013/0084133 A1 Apr. 4, 2013

Related U.S. Application Data

(60) Provisional application No. 61/540,679, filed on Sep. 29, 2011.

(51) Int. Cl.
*E01D 19/00* (2006.01)
*E01D 19/10* (2006.01)

(52) U.S. Cl.
USPC ..... 14/2.4; 14/69.5

(58) Field of Classification Search
USPC ..... 14/2.4, 69.5; 52/650.3; 182/63.1, 106; 105/436, 457
See application file for complete search history.

(56) References Cited

U.S. PATENT DOCUMENTS

| | | | | | |
|---|---|---|---|---|---|
| 56,238 | A * | 7/1866 | Smith, Jr. | 68/103 |
| 538,161 | A * | 4/1895 | Francis et al. | 105/437 |
| 560,238 | A * | 5/1896 | Smith, Jr. | 105/457 |
| 1,018,232 | A * | 2/1912 | Bessler | 182/79 |
| 1,141,385 | A * | 6/1915 | Ellinger | 52/646 |
| 4,017,932 | A * | 4/1977 | Lotto et al. | 14/2.4 |
| 4,168,764 | A * | 9/1979 | Walters | 182/1 |
| 4,403,362 | A * | 9/1983 | Durrant | 14/71.1 |
| 5,862,884 | A * | 1/1999 | Smith | 187/200 |
| 5,921,531 | A * | 7/1999 | Early | 256/67 |
| 7,225,896 | B2 * | 6/2007 | Broad | 182/106 |
| 8,387,191 | B2 * | 3/2013 | Honeycutt | 14/36 |
| 2002/0178683 | A1 * | 12/2002 | Phillips | 52/651.1 |

* cited by examiner

*Primary Examiner* — Gary Hartmann
(74) *Attorney, Agent, or Firm* — Shimokaji & Assoc., P.C.

(57) ABSTRACT

A pre-assembled walkway is provided, comprising an elongated walkway pan, a side railing subassembly, and a plurality of mounting brackets pivotally connecting the side railing subassembly to the walkway pan. The side railing subassembly comprises a plurality of vertical supports and handrails secured to tops of the vertical supports. The walkway is in a collapsed position when the side railing subassembly is pivoted in a first direction to the walkway pan with the vertical supports substantially parallel to the walkway pan and is in an erect position when the side railing subassembly is pivoted in a second, opposite direction with the vertical supports substantially orthogonal to the walkway pan.

8 Claims, 3 Drawing Sheets

PRE-ASSEMBLED COLLAPSIBLE WALKWAY

RELATED APPLICATIONS

The present application claims benefit of U.S. Provisional Application No. 61/540,679 filed Sep. 29, 2011, which application is incorporated herein by reference in its entirety.

BACKGROUND OF THE INVENTION

The present invention generally relates to the oilfield services industry and, in particular, to walkways used to service oilfield tanks.

Typically, such walkways are pre-assembled and are transported to an oilfield battery on a flatbed trailer. While the walkways are relatively light, they require a large amount of space on a trailer.

As can be seen, there is a need for a more efficient way to transport pre-assembled walkways.

SUMMARY OF THE INVENTION

In one aspect of the present invention, a pre-assembled walkway is provided, comprising an elongated walkway pan; a side railing subassembly, comprising a plurality of vertical supports; and handrails secured to tops of the vertical supports; and a plurality of mounting brackets pivotally connecting the side railing subassembly to the walkway pan, whereby the walkway is in a collapsed position when the side railing subassembly is pivoted in a first direction to the walkway pan with the vertical supports substantially parallel to the walkway pan and is in an erect position when the side railing subassembly is pivoted in a second, opposite direction with the vertical supports oriented substantially orthogonal to the walkway pan.

In another aspect of the present invention, a method for assembling a walkway is provided, comprising providing an elongated walkway pan; providing a plurality of vertical supports pivotally connected to the walkway pan; providing handrails secured to tops of each of the vertical supports; pivoting the vertical supports from a collapsed position with the vertical supports substantially parallel to the walkway pan into an erect position substantially orthogonal to the walkway pan; and securing the vertical supports in the erect position These and other features, aspects and advantages of the present invention will become better understood with reference to the following drawings, description and claims.

DETAILED DESCRIPTION OF THE INVENTION

The following detailed description is of the best currently contemplated modes of carrying out exemplary embodiments of the invention. The description is not to be taken in a limiting sense, but is made merely for the purpose of illustrating the general principles of the invention, since the scope of the invention is best defined by the appended claims.

Various inventive features are described below that can each be used independently of one another or in combination with other features.

Broadly, an embodiment of the present invention generally provides a pre-assembled collapsible steel walkway.

Figure 1:
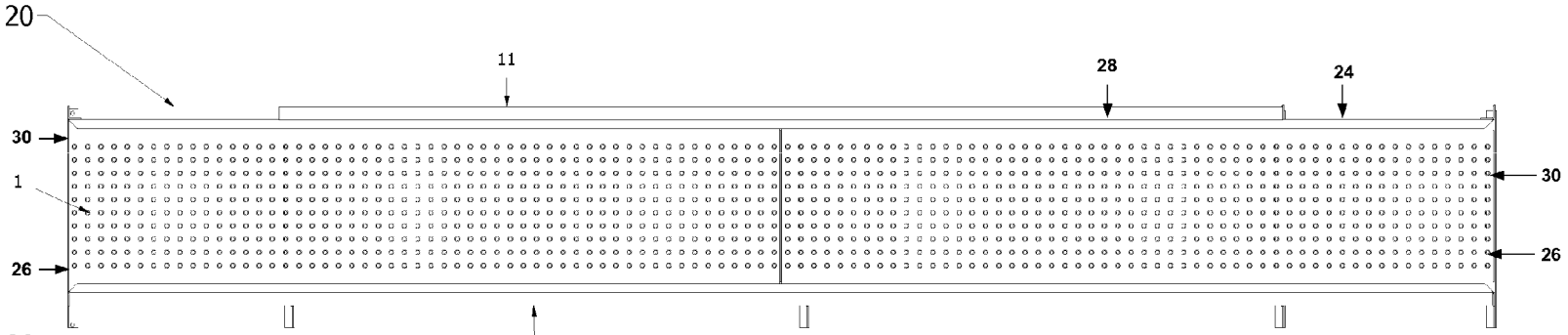
FIG. 1 is a top view of a pre-assembled collapsible walkway according to an embodiment of the present invention in an erect position.
Figure 2:
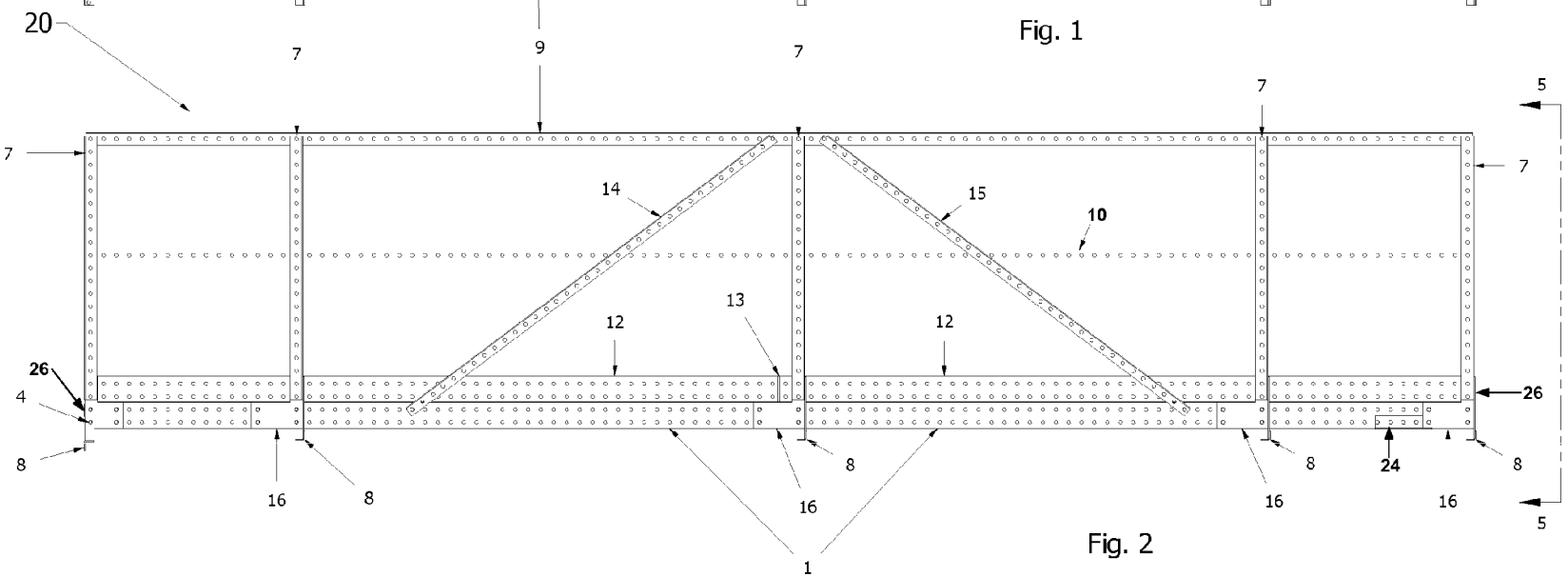
FIG. 2 is a front view of the walkway of FIG. 1.
Figure 3:
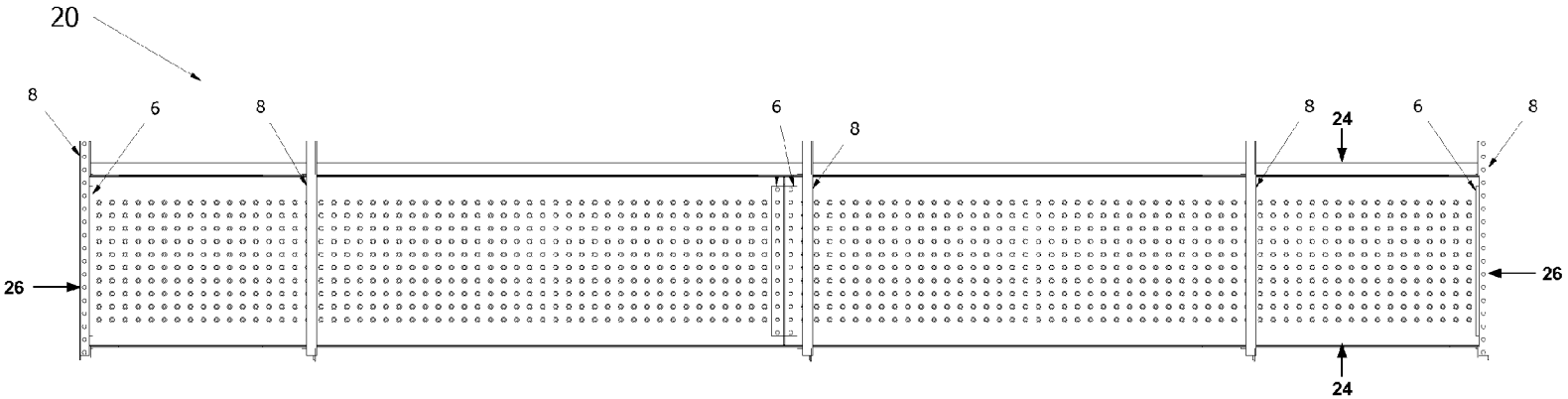
FIG. 3 is a bottom view of the walkway of FIG. 1.
Figure 4:
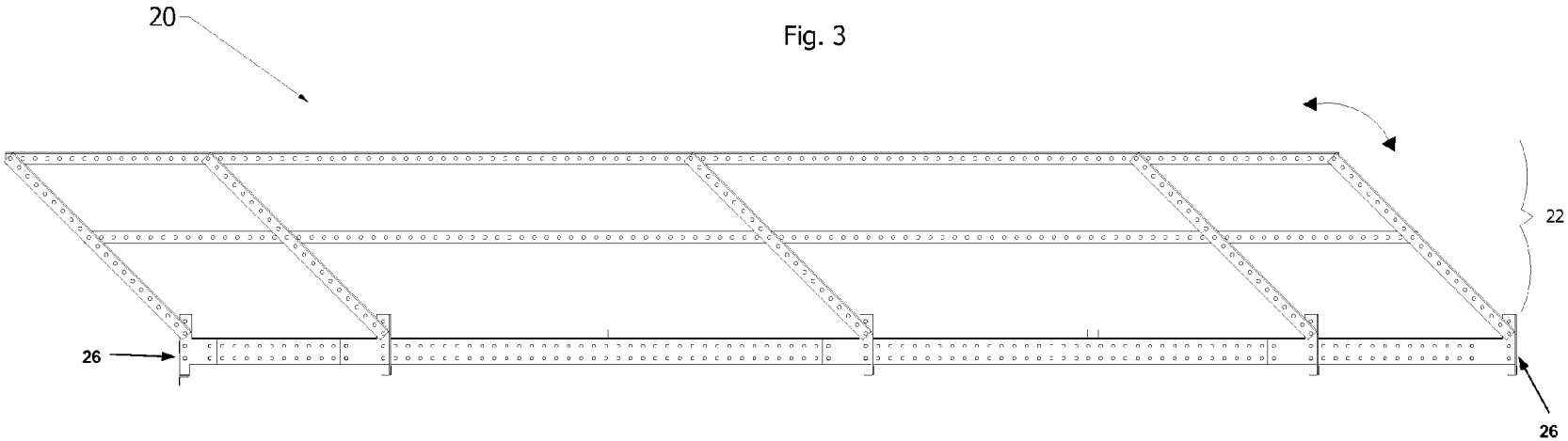
FIG. 4 is a front view of the walkway of FIG. 1 in a partially-erect position.
Figure 5:
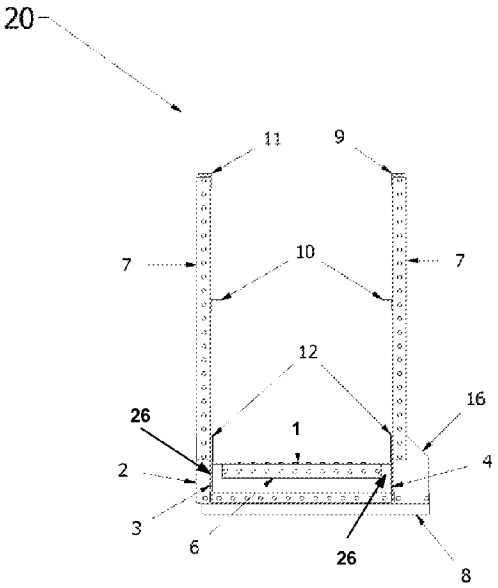
FIG. 5 is a side view from line 5-5 of the walkway of FIG. 1.

Referring now to FIGS. 1-5, different views of a pre-assembled walkway 20 are shown according to an exemplary embodiment of the present invention. The pre-assembled walkway 20 may include two lengthwise sides 28, two widthwise sides 30, and an elongated walkway pan 1 that may have downward-extending short vertical sides. The widthwise sides 30 may be shorter than, and perpendicular to, the lengthwise sides 28. The walkway pan 1 may include two an lengthwise sides 24, and two an widthwise sides 26. The pan widthwise sides 26 may be shorter than, and perpendicular to, the an lengthwise sides 24. Mounting brackets 2, 3, 4 and 16 may be affixed to the both pan lengthwise sides 24 of the walkway pan 1, such as on the vertical sides. Transversally disposed support beams 8 and lateral supports 6 may secured to the underside of the walkway pan 1 with the mounting brackets 2, 3, 4 and 16. A side railing subassembly 22 may be attached to each pan lengthwise side 24 of the walkway pan 1 with the mounting brackets 2, 3, 4 and 16. During preassembly, the side railing subassembly 22 may be secured to each bracket with only one fastener in each mounting bracket 2, 3, 4 and 16 to enable the side railing subassembly 22 to pivot up and down as illustrated in FIG. 4. The side railing subassembly 22 may include vertical supports 7 and handrails 9 and 11 fastened on both sides to the top of each of the vertical supports 7. Although five such supports 7 are shown in the FIGS. 2 and 4, the side railing subassembly 22 may have more or fewer supports 7. A mid-rail 10 may be fastened to the mid-portion of each of the vertical supports 7.

To erect the walkway 20 from its collapsed position with the side railing subassembly 22 substantially parallel to the walkway pan 1, the vertical supports 7 may be pivoted away from the walkway pan 1 to be substantially orthogonal to the walkway pan 1. Additional fasteners may be used to lock the vertical supports 7 to the mounting brackets 2, 3, 4 and 16 in their upright positions for use. Cross-braces 14 and 15 may be affixed to the pan lengthwise sides 24 of the walkway pan 1, the mid-rail 10, and the handrails 9 and 11 5 to enhance the rigidity of the side railing subassembly 22. Toe-boards 12 and 13 may be bolted in place along the pan lengthwise sides 24 of the walkway pan 1 and all fasteners may be tightened to complete the assembly of the walkway 20 in the erect position.

Fasteners that may fix the structure in its erect position may include nuts and bolts that may be torqued to achieve a required clamping force. Other fasteners that lock the side railing subassembly 22 in place may be of a non-clamping design, such as a lock and pin combination, making the installation of the side railing subassembly 22 fast and simple. The mounting brackets 2, 3, 4 and 16 may be made from structural steel with, for example, about 30 kilopound per square inch (KSI) of minimum yield strength.

In use, the erect walkway 20 may be secured to oil tanks using any of a variety of connecting methods. When work is completed on the oil tanks, the walkway 20 may be collapsed by removing the cross-braces 14, 15 and the additional fasteners from the mounting brackets 2, 3, 4 and 16, then pivoting the side railing assembly 22 towards the walkway pan 1.

The disclosed pre-assembled walkway 20 may provide a safe elevated platform for oilfield tank servicing and inspection. A worker may be safely contained within pre-assembled walkway 20 by the handrails 9, 11, the mid-rails 10, and the toe-boards 12, 13. A collapsed pre-assembled walkway 20 may occupy less than half of the space of a non-collapsible walkway, allowing more than one walkway to be loaded onto a single flatbed trailer, making its transportation more efficient.

It should be understood, of course, that the foregoing relates to exemplary embodiments of the invention and that modifications may be made without departing from the spirit and scope of the invention as set forth in the following claims.

We claim:

1. A pre-assembled walkway with two lengthwise sides and two widthwise sides, comprising:

an elongated walkway pan with two pan lengthwise sides and two pan widthwise sides;

a side railing subassembly, comprising:

a plurality of vertical supports; and handrails secured to tops of the vertical supports;

a plurality of mounting brackets pivotally connecting the side railing subassembly to the walkway pan, whereby the walkway is in a collapsed position when the side railing subassembly is pivoted in a first direction to the walkway pan with the vertical supports substantially parallel to the walkway pan and is in an erect position when the side railing subassembly is pivoted in a second, opposite direction with the vertical supports substantially orthogonal to the walkway pan;

at least one removable toe board fastened to one of the pan lengthwise sides of the walkway pan; and removable cross-braces fastened between the handrails and the walkway pan on both lengthwise sides of the preassembled walkway, wherein the pre-assembled walkway is collapsible upon removal of the cross-braces and the at least one toe board.

2. The pre-assembled walkway of claim 1, further comprising a mid-rail fastened to a mid-portion of each of the vertical supports on both sides of the preassembled walkway.

3. The pre-assembled walkway of claim 1, further comprising a plurality of support beams transversally secured to an underside of the walkway pan.

4. A method for assembling a walkway, comprising:

providing an elongated walkway pan with two pan lengthwise sides and two pan widthwise sides;

providing a plurality of vertical supports pivotally connected to the walkway pan;

providing handrails secured to tops of each of the vertical supports;

collapsing the walkway by removing a plurality of cross-braces affixed to the vertical supports and affixed to the walkway pan, and removing at least one toe board affixed to one of the lengthwise sides of the walkway pan;

pivoting the vertical supports from a collapsed position with the vertical supports substantially parallel to the walkway pan into an erect position substantially orthogonal to the walkway pan; and securing the vertical supports in the erect position.

5. The method of claim 4, further comprising fastening a mid-rail to a mid-portion of each of the vertical supports on both lengthwise sides of the preassembled walkway.

6. The method of claim 4, further comprising affixing a plurality of cross-braces between the elongated walkway pan and the handrails.

7. The method of claim 4, further comprising securing a plurality of transverse support beams to an underside of the walkway pan.

8. The method of claim 4, further comprising providing the walkway pan, the vertical supports, and the handrails in a collapsed position at a first location and pivoting and securing the vertical supports in an erect position at a second location.

* * * * *